US007690729B2

(12) United States Patent
Liao

(10) Patent No.: US 7,690,729 B2
(45) Date of Patent: Apr. 6, 2010

(54) ADJUSTABLE CHAIR HEADREST FRAME

(76) Inventor: Tzu-Ying Liao, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 12/191,319

(22) Filed: Aug. 14, 2008

(65) Prior Publication Data

US 2010/0038949 A1 Feb. 18, 2010

(51) Int. Cl.
*A47C 7/40* (2006.01)

(52) U.S. Cl. ..... 297/408; 297/410

(58) Field of Classification Search ..... 297/353, 297/408, 410, 411.36
See application file for complete search history.

(56) References Cited

U.S. PATENT DOCUMENTS 3,477,761 A * 11/1969 Krantz ..... 297/409
3,885,831 A * 5/1975 Rasmussen ..... 297/410
5,435,626 A * 7/1995 Lai ..... 297/411.36
5,678,893 A * 10/1997 Bock ..... 297/353
5,685,609 A * 11/1997 Miotto ..... 297/353
5,918,938 A * 7/1999 Miotto ..... 297/353
6,062,646 A * 5/2000 Bock ..... 297/411.36
6,857,704 B2 * 2/2005 Stenzel et al. ..... 297/408
7,370,912 B2 * 5/2008 Williams et al. ..... 297/256.11
2007/0246988 A1 * 10/2007 Hung ..... 297/353

* cited by examiner

*Primary Examiner*—Peter R. Brown

(57) ABSTRACT

An adjustable chair headrest frame includes a headrest provided with a pivotal frame at the rear side. A support frame is pivotally assembled with the pivotal frame of the headrest, having its inner side formed with a recessed face having its outer periphery fixed with plural female-thread studs. An adjusting device is combined at the inside of the support frame, composed of a fit plate, plural stop blocks, a holding plate, springs and a back plate. A combining plate is threadably combined with the fit plate of the adjusting device and assembled at the rear side of a chair. By so designing, the headrest frame can be adjusted upward or downward, and the headrest can be adjusted and positioned at different angles.

2 Claims, 6 Drawing Sheets

ADJUSTABLE CHAIR HEADREST FRAME

BACKGROUND OF THE INVENTION

1. Field of the Invention

This invention relates to an adjustable chair headrest frame, particularly to one assembled on a chair for a user's head to rest thereon, able to be adjusted upward or downward for matching with a user's height and enabling a headrest to be adjusted at different angles.

2. Description of the Prior Art

A chair with a headrest enables a user to rest on the chair and lean his head on the headrest for relaxing tense muscles of the shoulders and the neck after the user has done office work for a long time. However, a conventional chair headrest is generally fixed immovably on a chair and hence cannot be adjusted upward or downward for tallying with different heights of users, nor can it be adjusted in angles for effectively supporting a user's head on the headrest.

SUMMARY OF THE INVENTION

The objective of this invention is to offer an adjustable chair headrest frame able to be adjusted upward or downward for matching with a user's height and enabling a headrest to be adjusted at different angles.

The adjustable chair headrest frame in the present invention includes a headrest provided with a pivotal frame at the rear side. A support frame is pivotally combined with the headrest, formed with a recessed face having its outer periphery disposed with plural female-thread studs. An adjusting device is threadably combined with the support frame of the headrest, composed of a fit plate, plural stop blocks, a holding plate, springs and a back plate. The fit plate has one side bored with at least one channel, and two stop blocks are respectively received in the opposite ends of the channel of the fit plate. Each stop block has its outer circumferential side provided with projecting edges and its inner side fixed with a projecting member. The spring is received in the channel of the fit plate and has its opposite ends respectively fitted on the projecting members of the two opposite stop blocks. The holding plate is formed with an accommodating chamber for receiving the fit plate and the stop blocks therein, and the accommodating chamber has its lower side bored with at least one lengthwise guide groove and its inner opposite sides respectively disposed with continuously-arranged positioning notches. The back plate to be threadably assembled with the fit plate is positioned at the rear side of the holding plate and bored with plural through holes respectively corresponding with the guide grooves of the holding plate. The combining plate is threadably assembled with the fit plate of the adjusting device and combined at the rear side of the chair.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
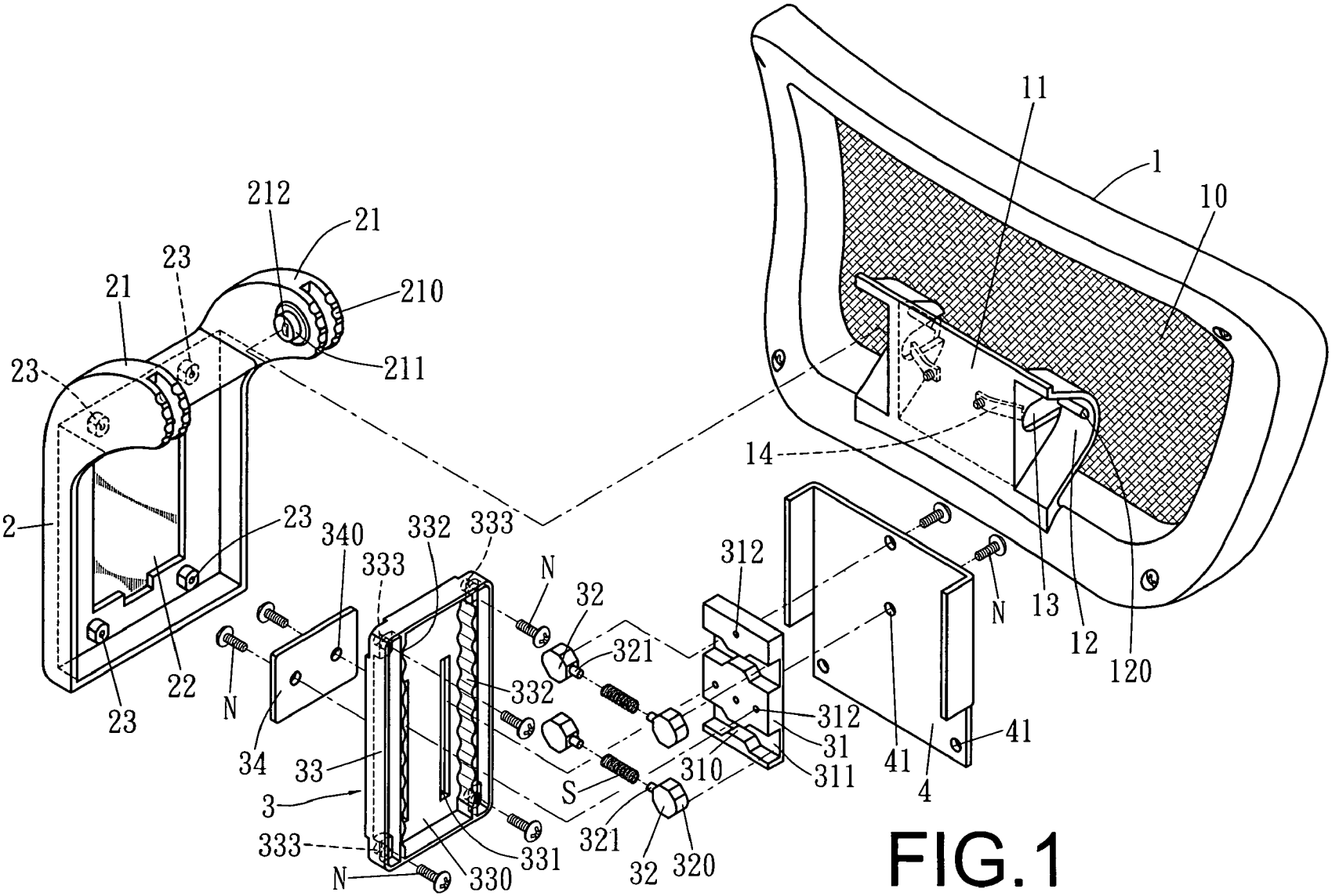
FIG. 1 is an exploded perspective view of an adjustable chair headrest frame in the present invention.
Figure 2:
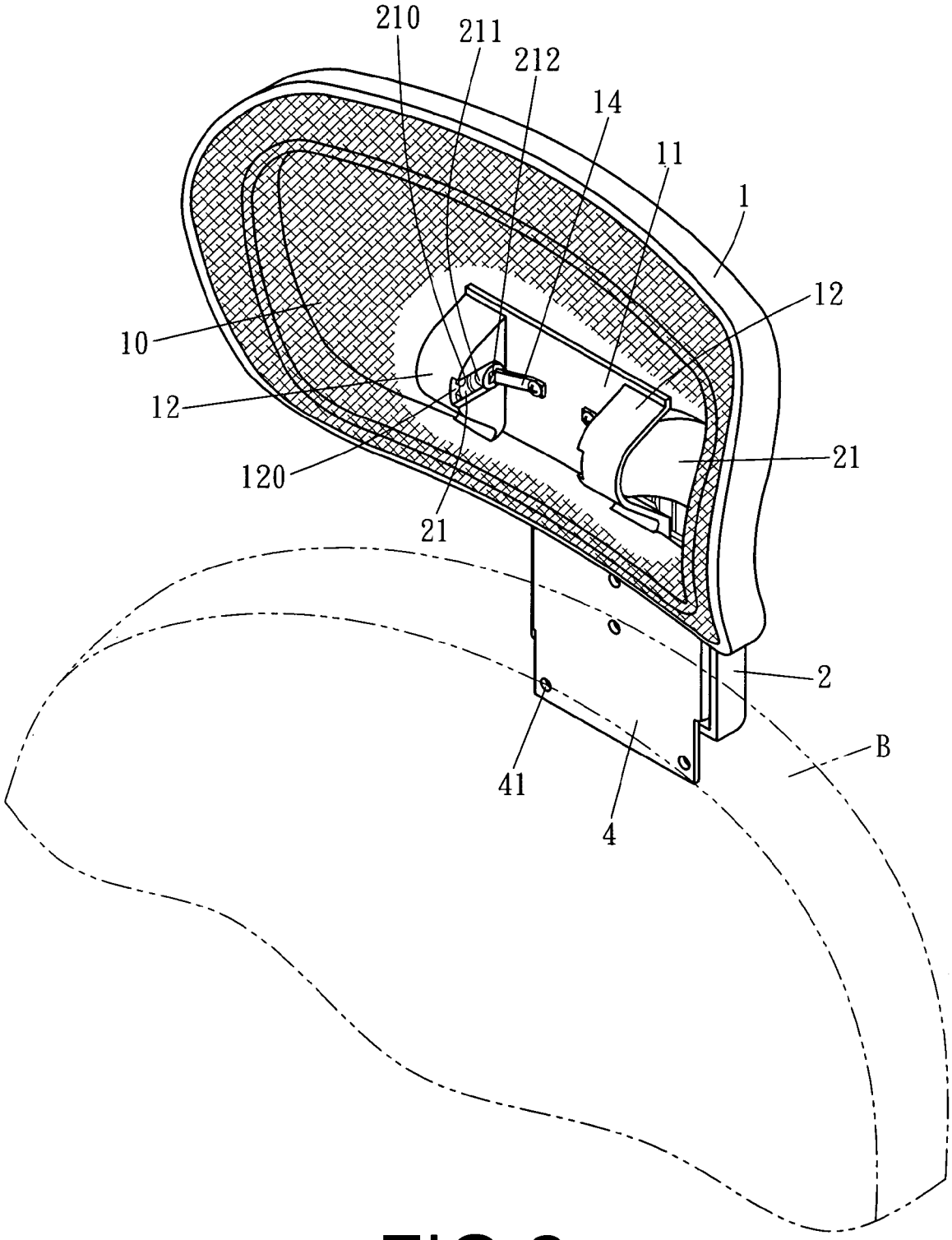
FIG. 2 is a front view of the adjustable chair headrest frame in the present invention.

A preferred embodiment of an adjustable chair headrest frame shown in FIGS. 1 and 2, includes a headrest 1, a support frame 2, an adjusting device 3 and a combining plate 4 as main components combined together.

The headrest 1 has its front side provided thereon with ventilating net fabric 10 and its rear side fixed with a pivotal frame 11 having its opposite sides respectively disposed with an arcuate plate 12 and a pivot hole 13. The two arcuate plates 12 have their inner walls respectively fixed thereon with an engage bar 120 and the pivotal frame 11 has its inner wall secured with two opposite resisting members 14 having their outer ends respectively corresponding with the pivot holes 13.

The support frame 2 to be pivotally combined with the pivotal frame 11 of the headrest 1 has its opposite sides respectively formed with an arcuate pivotal rod 21 having its front end shaped as a circular arc to match with the arcuate plate 12 of the pivotal frame 11. Each pivotal rod 21 of the support frame 2 has the arcuate side of its front end cut with several engage notches 210 arranged in order and corresponding with the engage bars 120 on the arcuate plates 12. Further, the two pivotal rods 21 have the inner sides respectively fixed with a pivotal block 211 protruding outward to correspond with the pivot hole 13 of the pivotal frame 11 and having a stopper 212 fixed thereon. Furthermore, the support frame 2 has its inner side formed with a recessed face 22 having its outer periphery disposed with plural female-thread studs 23.

The adjusting device 3 to be fitted in the recessed face 22 of the support frame 2 consists of a fit plate 31 having one side formed with at least one passageway 310 having its opposite sides respectively bored with a stop-block groove 311, and the fit plate 31 is bored with a plurality of threaded holes 312. At least two stop blocks 32 are to be respectively received in the stop-block grooves 311 of the fit plate 31 and have their outer circumferential sides respectively and axially disposed with plural projecting edges 320 and their inner sides respectively fixed with a projecting member 321, and a spring (S) to be received in the passageway 310 of the fit plate 31 has its opposite ends respectively fitted on the opposite projecting members 321 of the two stop blocks 32. A holding plate 33 is provided inside with an accommodating chamber 330 for receiving the fit plate 31 and the stop blocks 32 therein. The accommodating chamber 330 has its lower side bored with two lengthwise guide grooves 331 and its inner opposite sides respectively disposed with continuously arranged wave-shaped positioning notches 332, further having its four corners respectively bored with a threaded hole 333 to match with the female-thread stud 23 of the support frame 2. A back plate 34 to be positioned at the rear side of the holding plate 33 is bored with plural through holes 340 respectively aligned to both the guide grooves 331 of the holding plate 33 and the threaded holes 312 of the fit plate 31, and then a screw (N) is inserted through them to combine the back plate 34 together with the holding plate 33 and the fit plate 31.

The combining plate 4 is threadably combined with the fit plate 31 of the adjusting device 3 and assembled at the rear side of the chair, bored with plural threaded holes 41.

Figure 3:
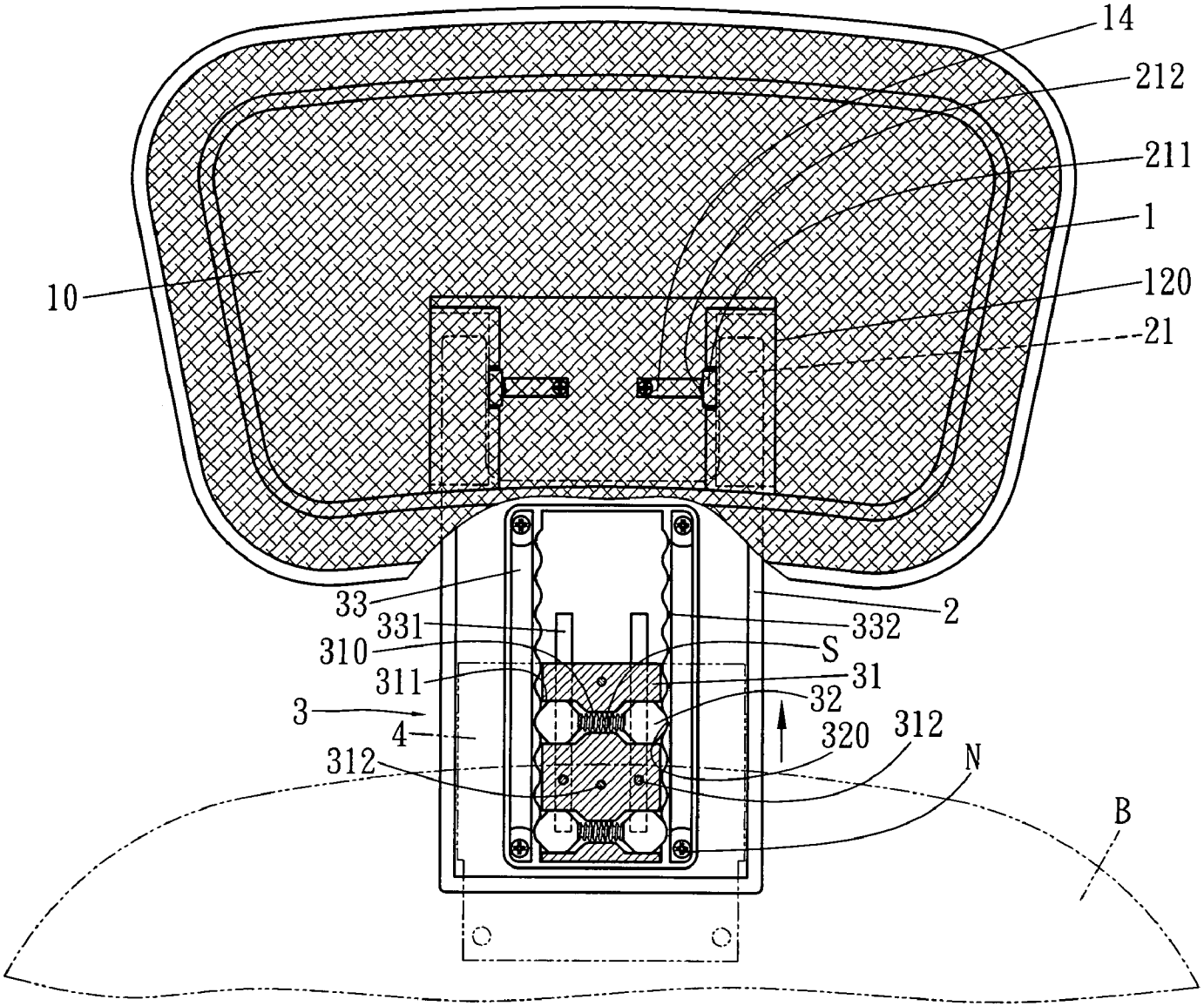
FIG. 3 is a cross-sectional view of the adjustable chair headrest frame adjusted upward in the present invention.

In assembling, referring to FIGS. 1, 2 and 3, firstly, the spring (S) has its opposite ends respectively fitted on the opposite projecting members 321 respectively on the inner side of the two stop blocks 32, and then the stop blocks 32 are respectively received in the stop-block grooves 311 of the fit plate 31 and the spring (S) is fitted in the passageway 310 of the fit plate 31. Next, the fit plate 31 together with the stop blocks 32 is received in the accommodating chamber 330 of the holding plate 33, letting the projecting edges 320 on the outer circumferential side of the stop blocks 32 resist against the positioning notches 332 at the opposite inner walls of the accommodating chamber 330 of the holding plate 33. Subsequently, the back plate 34 is positioned at the rear side of the holding plate 33, letting the through holes 340 of the back plate 34 respectively aligned to the threaded holes 312 of the fit plate 31, and then having screws (N) respectively inserted through them to combine the back plate 34 together with the holding plate 33 and the fit plate 31. Afterward, the threaded holes 333 of the holding plate 33 respectively are aligned to the female-thread studs 23 of the support frame 2 and locked together by screws (N), and then the threaded holes 41 and 312 of the combining plate 4 and the fit plate 31 are respectively in alignment to be locked together by other screws (N). Then, the two pivotal rods 21 of the support frame 2 are respectively positioned on the two arcuate plates 12 at the opposite sides of the pivotal frame 11 to be pivotally combined with the pivotal frame 11 of the headrest 1 by having the two pivotal blocks 211 respectively inserted in the two pivotal holes 13, letting the two resisting plates 14 of the pivotal frame 11 respectively resist against the edges of the two stoppers 212 on the pivotal blocks 211, and the engage bars 120 on the two arcuate plates 12 correspondingly engaged in the engage notches 210 of the two pivotal rods 21. Lastly, the combining plate 4 is firmly combined with the back (B) of the chair to finish assembling the adjustable headrest frame.

Figure 4:
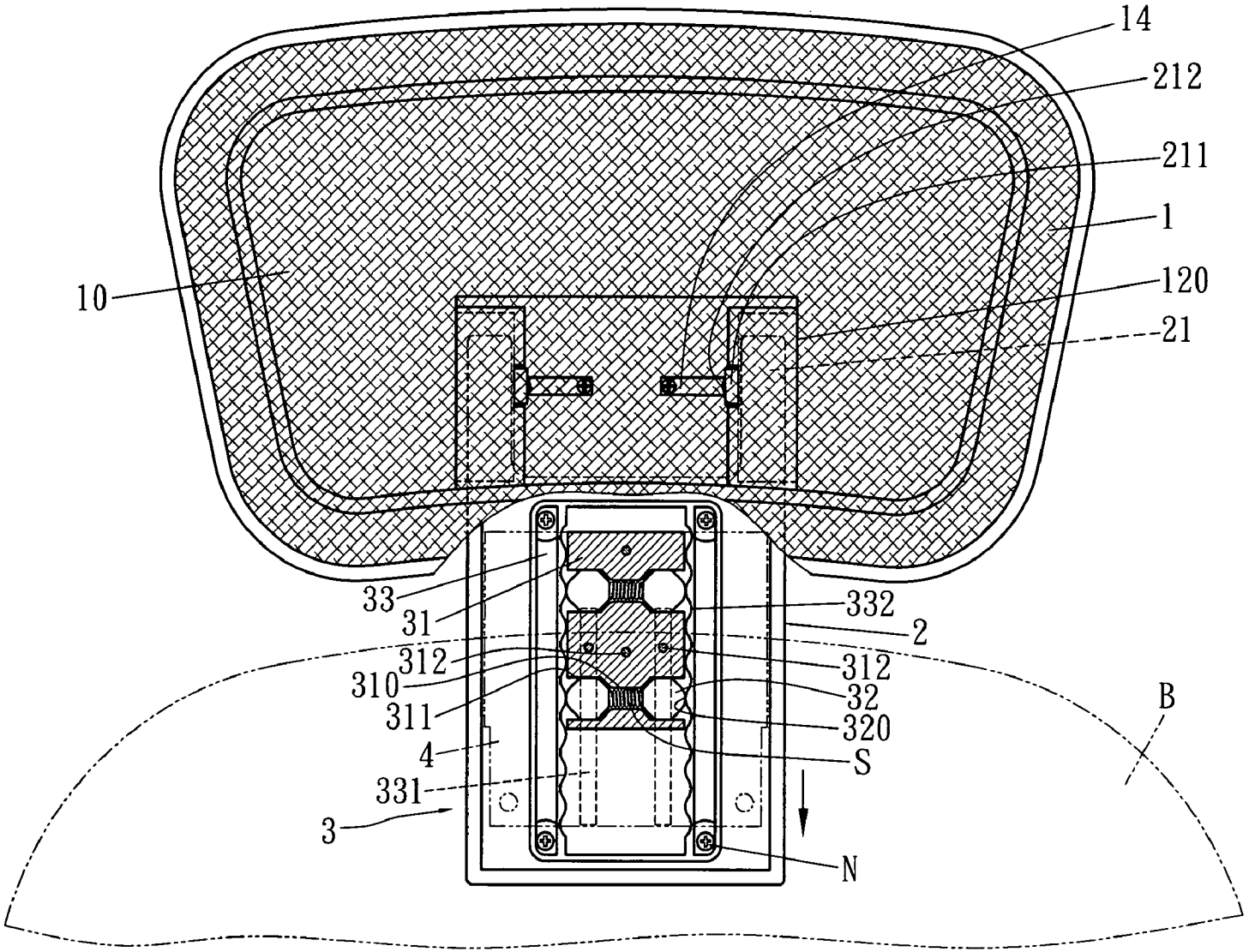
FIG. 4 is a cross-sectional view of the adjustable chair headrest frame adjusted downward in the present invention.

To adjust the headrest upward or downward, referring to FIGS. 3 and 4, a user only needs to pull up or press down the headrest 1 to let the support frame 2 actuate the holding plate 33 of the adjusting device 3 to shift. Since the fit plate 31 and the back plate 34 are connected by the screws (N), which are able to respectively slide in the guide grooves 331 of the holding plate 33; therefore, when the holding plate 33 is moved upward or downward, the opposite walls of the accommodating chamber 330 of the holding plate 33 will respectively press the opposite stop blocks 32 to shrink inward and compress the spring (S). And when the projecting edges 320 of the stop blocks 32 are respectively aligned to the opposite positioning notches 332 of the holding plate 33, the spring (S) will recover its elastic force to push the stop blocks 32 to move outward and respectively be engaged with other positioning notches 332 and fixed therein, thus able to adjust upward or downward the headrest 1.

Figure 5:
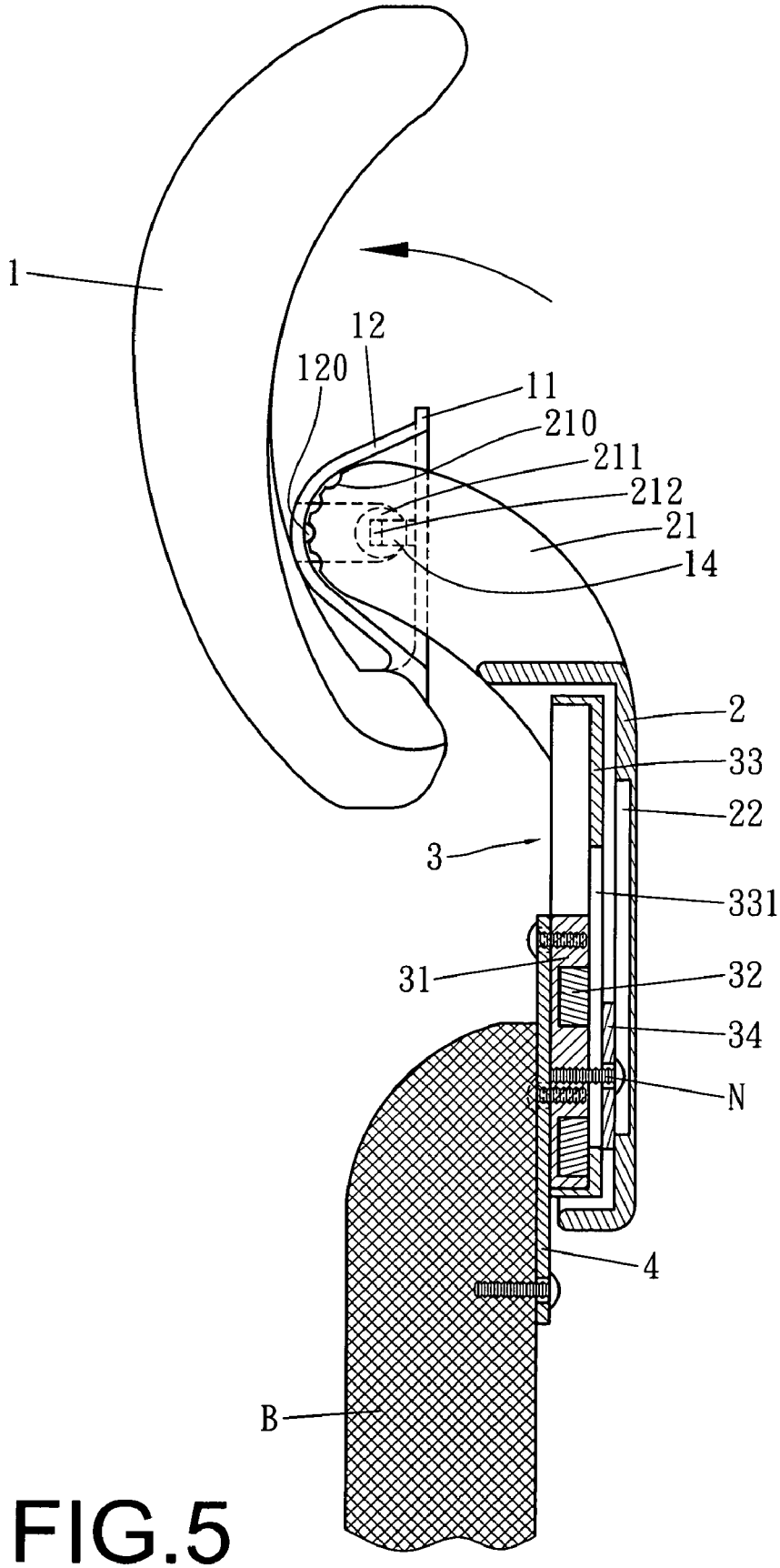
FIG. 5 is a side cross-sectional view of the adjustable chair headrest frame having a headrest adjusted at an angle in the present invention.
Figure 6:
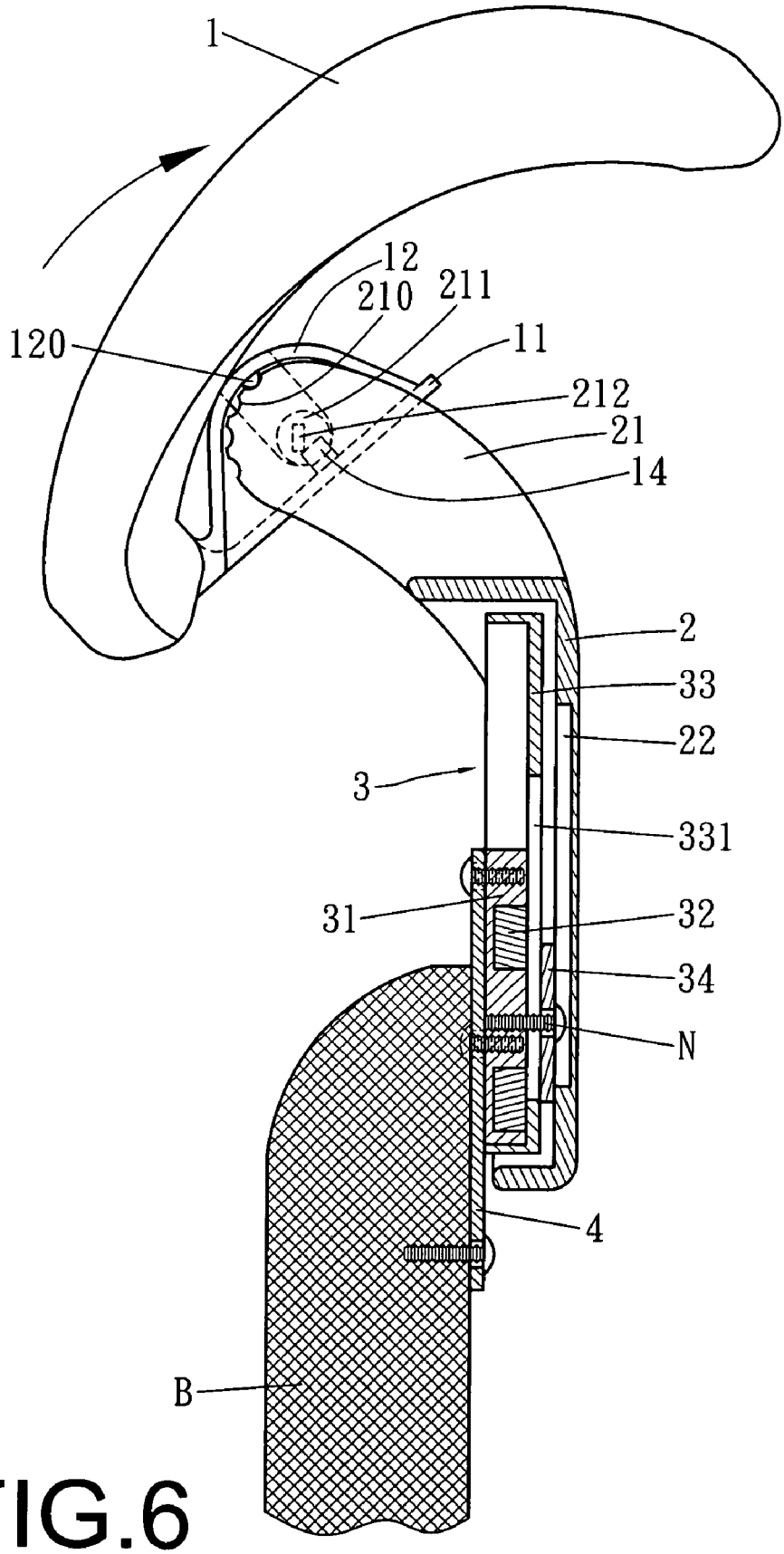
FIG. 6 is a side cross-sectional view of the adjustable chair headrest frame having the headrest adjusted at another angle in the present invention.

To adjust the headrest at a proper elevation angle, referring to FIGS. 5 and 6, simply turn the headrest upward to let the opposite engage bars 120 on the two arcuate plates 12 of the headrest 1 respectively and correspondingly engaged in the engage notches 210 at different locations. Meanwhile, the opposite resisting members 14 on the pivotal frame 11 will respectively resist against the stoppers 212 on the pivotal blocks 211 of the two pivotal rods 21 for tightly fixing the headrest 1 in position.

While the preferred embodiment of the invention has been described above, it will be recognized and understood that various modifications may be made therein and the appended claims are intended to cover all such modifications that may fall within the spirit and scope on the invention.

What is claimed is:

1. An adjustable chair headrest frame comprising:

a headrest provided with a pivotal frame at a rear side;

a support frame pivotally combined with said pivotal frame of said headrest, said support frame formed with a recessed face having its outer periphery board with plural threaded holes;

an adjusting device threadably assembled with said support frame, said adjusting device composed of a fit plate, at least one stop block, a holding plate, springs and a back plate, said fit plate having one side disposed with at least one passageway, at least one stop block received in opposite ends of a channel of said fit plate, said stop block having its outer circumferential side provided with projecting edges and its inner side fixed with a projecting member, each spring having its opposite ends respectively fitted on said projecting member of said at least one stop block, said spring received in said passageway of said fit plate, said holding plate formed with an accommodating chamber for receiving said fit plate and said stop blocks therein, said accommodating chamber having its lower side bored with at least one guide groove, said accommodating chamber having its inner opposite sides respectively disposed with continuously-arranged positioning notches, wherein when the projecting edges of the stop block are respectively aligned to said opposite positioning notches, a respective one of said springs will recover its elastic force to push said stop blocks to move outward and respectively be engaged with other positioning notches and fixed therein, said back plate positioned at rear side of said holding plate, said back plate bored with through holes respectively corresponding with said at least one guide groove of said holding plate, said back plate threadably assembled with said fit plate; and a combining plate threadably assembled with said fit plate of said adjusting device and connected at a rear side of a chair.

2. The adjustable chair headrest frame as claimed in claim 1, wherein said pivotal frame of said headrest has its opposite sides respectively formed with an arcuate plate and a pivot hole, and each said arcuate plate has its inner wall fixed with an engage bar, said pivotal frame having its inner wall secured with resisting members respectively having an outer and facing a pivotal hole; and wherein said supporting frame has its opposite sides respectively formed with a pivotal rod having its front end matching with said arcuate plate of said pivotal frame, each said pivotal rod having an outer side of its front end cut with several engage notches for being engaged with the engage bars, each said pivotal rod disposed with a pivotal block, said pivotal block having its inner side fixed with a stopper protruding outward; wherein in assembly, the resisting members on the pivotal frame will respectively resist against the stoppers of the pivotal blocks of the two pivotal rods for tightly fixing the headrest in position.

* * * * *